US012789032B2

(12) United States Patent
Casagrande et al.

(10) Patent No.: US 12,789,032 B2
(45) Date of Patent: Nov. 10, 2026

(54) GYMNASTIC MACHINE

(71) Applicant: TECHNOGYM S.P.A., Cesena FC (IT)

(72) Inventors: Simone Casagrande, Cesena FC (IT); Paolo Tognini, Cesena FC (IT)

(73) Assignee: TECHNOGYM S.P.A., Cesena FC (IT)

( * ) Notice: Subject to any disclaimer, the term of this patent is extended or adjusted under 35 U.S.C. 154(b) by 114 days.

(21) Appl. No.: 18/584,806

(22) Filed: Feb. 22, 2024

(65) Prior Publication Data

US 2024/0285993 A1 Aug. 29, 2024

(30) Foreign Application Priority Data

Feb. 23, 2023 (IT) ..... 102023000003183

(51) Int. Cl.
*A63B 21/04* (2006.01)
*A63B 21/00* (2006.01)
(Continued)

(52) U.S. Cl.
CPC ..... *A63B 21/0421* (2013.01); *A63B 21/0557* (2013.01); *A63B 21/0615* (2013.01); *A63B 21/4035* (2015.10)

(58) Field of Classification Search
CPC ..... A63B 21/00061; A63B 21/00065; A63B 21/00069; A63B 21/0407; A63B 21/0414; A63B 21/0421; A63B 21/0428; A63B 21/0435; A63B 21/0442; A63B 21/0552; A63B 21/0557; A63B 21/0615; A63B 21/0616; A63B 21/065; A63B 21/159; A63B 21/4009; A63B 21/4034; A63B 21/4035; A63B 21/4047; A63B 21/4049; A63B 22/0046; A63B 22/0076; A63B 2022/0033; A63B 2022/0035;
(Continued)

(56) References Cited

U.S. PATENT DOCUMENTS 4,357,010 A * 11/1982 Telle ..... A63B 21/4047 482/97
4,589,658 A * 5/1986 Gibson ..... A63B 21/4001 482/97
(Continued)

FOREIGN PATENT DOCUMENTS

EP 0177017 A2 * 4/1986 ..... A63B 21/08
KR 101975563 B1 * 5/2019 ..... A63B 23/0405

OTHER PUBLICATIONS

European Search Report dated Jul. 10, 2024 for EP Application No. 24158299.8 filed Feb. 19, 2024.
(Continued)

*Primary Examiner* — Gary D Urbiel Goldner
(74) *Attorney, Agent, or Firm* — Knobbe, Martens, Olson & Bear, LLP

(57) ABSTRACT

A gymnastic machine includes a frame, a movable lever, pivoted to the frame, so as to assume a lowered position and a raised position, and at least one weight, which can be coupled to the movable lever. The gymnastic machine includes at least one elastic element, which connects the movable lever to the frame, so as to oppose an elastic force aimed at compensating a force of the at least one weight when the movable lever is close to the lowered position.

5 Claims, 6 Drawing Sheets

(51) Int. Cl.
*A63B 21/055* (2006.01)
*A63B 21/06* (2006.01)

(58) Field of Classification Search
CPC .... A63B 2022/0041; A63B 2022/0082; A63B 23/04; A63B 2023/0411; A63B 69/0057; A63B 69/0059; A63B 2208/0204; A63B 2225/09; A63B 2225/093; A63B 2244/09
See application file for complete search history.

(56) References Cited

U.S. PATENT DOCUMENTS 4,674,160 A * 6/1987 Gibson ..... A63B 21/4047 482/97
5,158,520 A * 10/1992 Lemke ..... A63B 21/06 482/133
9,511,258 B2 * 12/2016 Hoole ..... A63B 21/0615
10,220,233 B2 * 3/2019 Schmidt ..... A63B 21/4035
12,023,539 B2 * 7/2024 Adams ..... A63B 21/4033
2004/0058790 A1 3/2004 Lapcevic
2011/0028280 A1 * 2/2011 Adams ..... A63B 21/4047 482/94
2013/0210592 A1 * 8/2013 Hoole ..... A63B 21/0552 482/129
2014/0135184 A1 5/2014 Hoole
2014/0274584 A1 * 9/2014 Hoole ..... A63B 21/0421 482/72
2016/0346586 A1 * 12/2016 Pullins ..... A63B 21/4033
2017/0157455 A1 6/2017 Kelly
2017/0203149 A1 * 7/2017 D'Amico ..... A63B 21/0615
2020/0094099 A1 * 3/2020 Kelly ..... A63B 21/0609

OTHER PUBLICATIONS

Italian Search Report for Italian Patent Application No. IT202300003183 dated Sep. 5, 2023 in 7 pages.

* cited by examiner

GYMNASTIC MACHINE

CROSS-REFERENCE TO RELATED APPLICATIONS

This application claims priority to Italian Patent Application No. 102023000003183, filed on Feb. 23, 2023, which is incorporated herein by reference in its entirety.

TECHNICAL FIELD

The present disclosure relates to an improved gymnastic machine.

In more detail, the disclosure concerns a machine for carrying out lifting exercises, such as, by way of example, machines for carrying out "squat" exercises, designed and realized in particular to allow optimal restoration of the load conditions in the so-called eccentric phases. In the following, the description will be directed to machines for training a user's lower limbs, but it is clear that it should not be considered limited to this specific use.

BACKGROUND

As is well known, gymnastic machines for the strength and muscular resistance of a user are currently very widespread, which guide the movement of the user and assist him in the correct execution of gymnastic exercises.

In particular, the movement performed by a user during the execution of a gymnastic exercise is divided into a concentric phase and an eccentric phase. The concentric phase is the one in which the user exerts enough force to overcome resistance, following a predetermined trajectory. The eccentric phase, on the other hand, is the phase in which the user exerts such a force that it is overcome by the resistance, following a trajectory equal and opposite to that of the concentric phase. Typically, the beginning of the concentric phase and the end of the eccentric phase are the most challenging moments of the movement for the user.

Gymnastic machines are well known that allow the movement to be opposed to an inertial type of resistance, i.e., caused by the presence of one or more bodies or weights, which oppose their mass (weight) to the movement.

Gymnastic machines are also known which allow the movement to be opposed to elastic resistance as an alternative to that caused by one or more weights. In this case, one or more elastic elements are generally provided, capable of exerting resistance to the movement proportional to their lengthening or extension. In general, due to the elastic properties of these elements, the resistance exerted by said machines is minimum at the beginning of the concentric phase, and maximum at the end of said concentric phase. Similarly, the elastic resistance is maximum at the beginning of the eccentric phase and minimum at the end of the eccentric phase.

It often happens that the user finds uncomfortable the transition phases of the exercise from the eccentric and concentric phase and vice versa.

Therefore, it is clear that this limit is particularly inconvenient for users of gymnastic machines, and in particular for those used to perform squats and similar exercises.

SUMMARY

In light of the above, it is, therefore, the purpose of some embodiments of the present disclosure to propose a gymnastic machine that allows the limits of the prior art to be overcome, providing mechanisms that provide assistance to the user in the most demanding phases of the exercises, maintaining uniform effort, and limiting any risks.

Another purpose of some embodiments of the disclosure is to propose a gymnastic machine that is easy to make, without excessively modifying the structure of known gymnastic machines.

It is specific object of some embodiments of the present disclosure a gymnastic machine comprising a frame, a movable lever, pivoted to said frame, so as to assume a lowered position and a raised position, and at least one weight, which can be coupled to said movable lever, characterized in that it comprises at least one elastic element, which connects said movable lever to said frame, so as to oppose the elastic force aimed at compensating the force of said at least one weight when said movable lever is near the lowered position.

In particular, the elastic element is arranged so as to exert an elastic force in the opposite direction with respect to the force of gravity.

Advantageously, the elastic element is adapted to support part of the load of said at least one weight.

In particular, the elastic element is arranged to at least partially support the weight or load that is moving the user.

Always according to some embodiments of the disclosure, said frame may comprise at least one first fixing pin, and said movable lever comprises at least one second fixing pin, wherein said elastic element is connected between said first fixing pin and said second fixing pin.

Still according to some embodiments of the disclosure, said machine may comprise one or more hooks arranged on said movable lever, intended to be coupled to a lifting belt worn by a user.

Advantageously according to some embodiments of the disclosure, said frame may comprise a support element, having a framework, which has a rotation pin at its top, and said movable member comprises a pair of beams arranged parallel and coupled to each other, wherein each beam is rotatably coupled at a first end to said rotation pin, so as to assume a lowered position and a raised position, wherein said movable member also comprises one or more weight pins, each arranged coupled to a respective beam, for the arrangement of at least one respective weight, wherein said movable lever comprises a coupling element of said pair of beams, and wherein said one or more hooks are disposed on said coupling element.

Further according to some embodiments of the disclosure said machine may comprise a base and a handlebar, having a column fixed at a first end to the base, and handles, fixed to the second end of said column.

Always according to some embodiments of the disclosure, said one or more first fixing pins are arranged on said support.

Advantageously according to some embodiments of the disclosure, said frame may comprise a pair of branches, on each of which said first fixing pins are arranged, and said movable lever may comprise two arms arranged substantially parallel, on each of which one or more of said second fixing pins are arranged.

Further according to some embodiments of the disclosure, said machine may comprise a crosspiece arranged between said arms.

Preferably according to some embodiments of the disclosure, said elastic element may be an elastic band.

Still according to some embodiments of the disclosure, said elastic band may be of the closed type or is of the open type and comprises two eyelets at the ends.

BRIEF DESCRIPTION OF THE DRAWINGS

The present disclosure will be now described, for illustrative but not limitative purposes, according to its preferred embodiments, with particular reference to the figures of the enclosed drawings, wherein.

DETAILED DESCRIPTION

Figure 1:
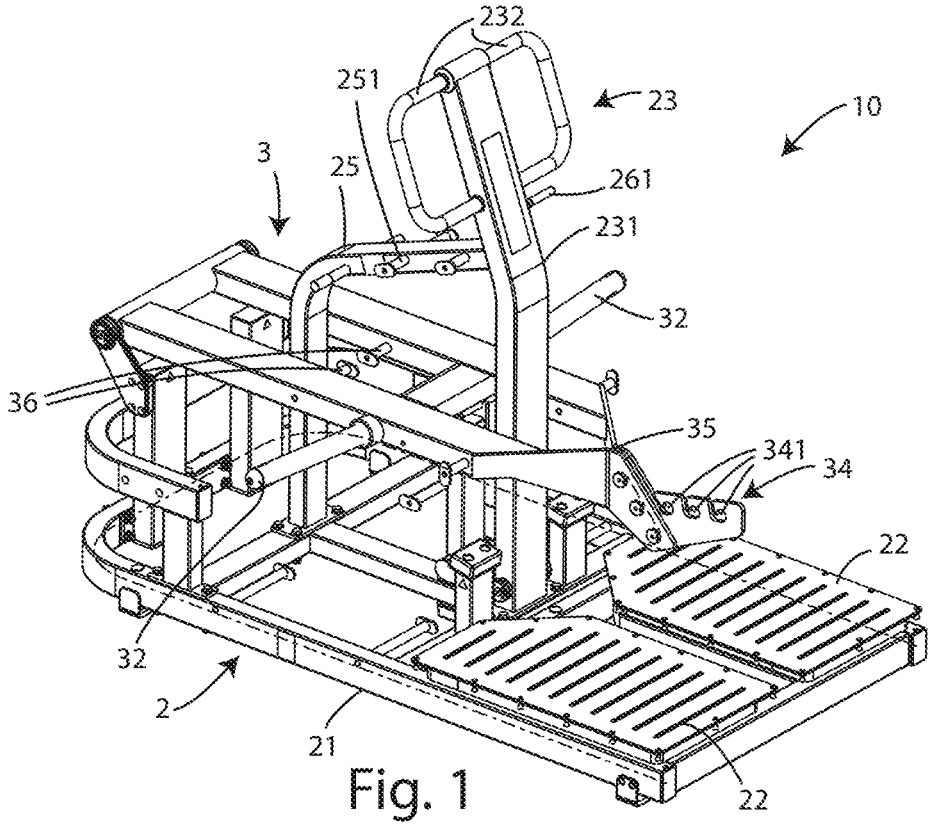
FIG. 1 shows a first rear perspective view of a first embodiment of a gymnastic machine according to the present disclosure.
Figure 2:
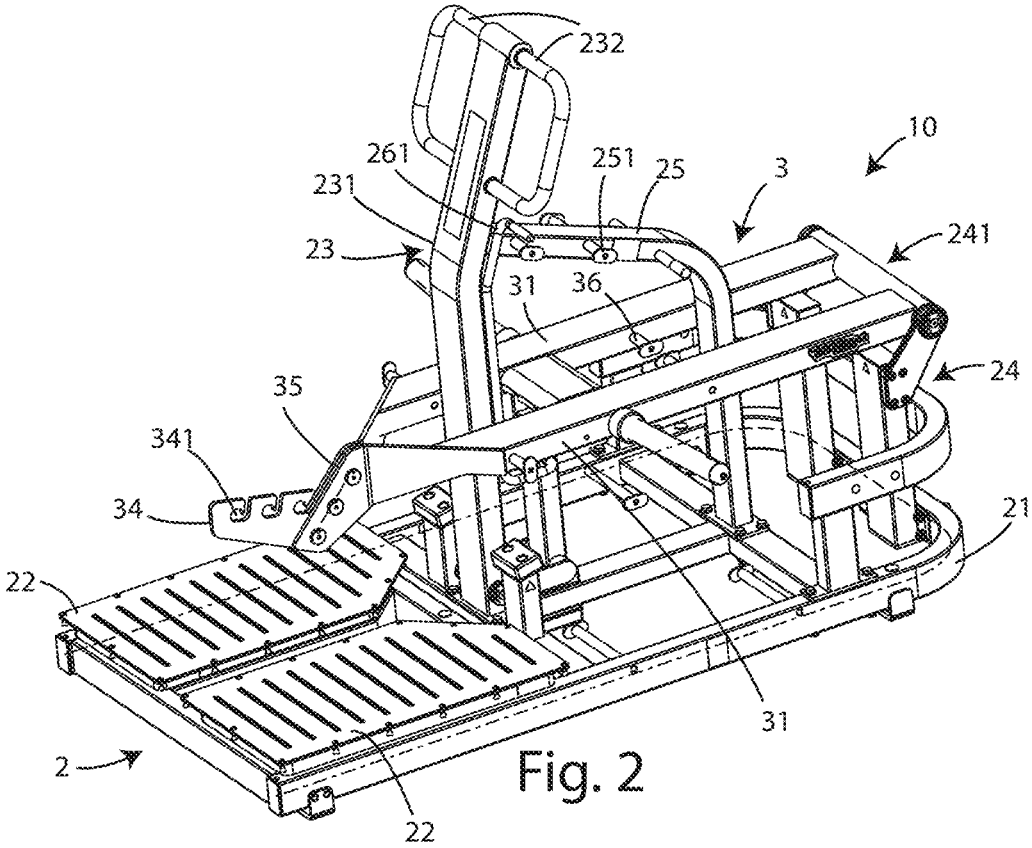
FIG. 2 shows a second rear perspective view of a gymnastic machine of FIG. 1.
Figure 3:
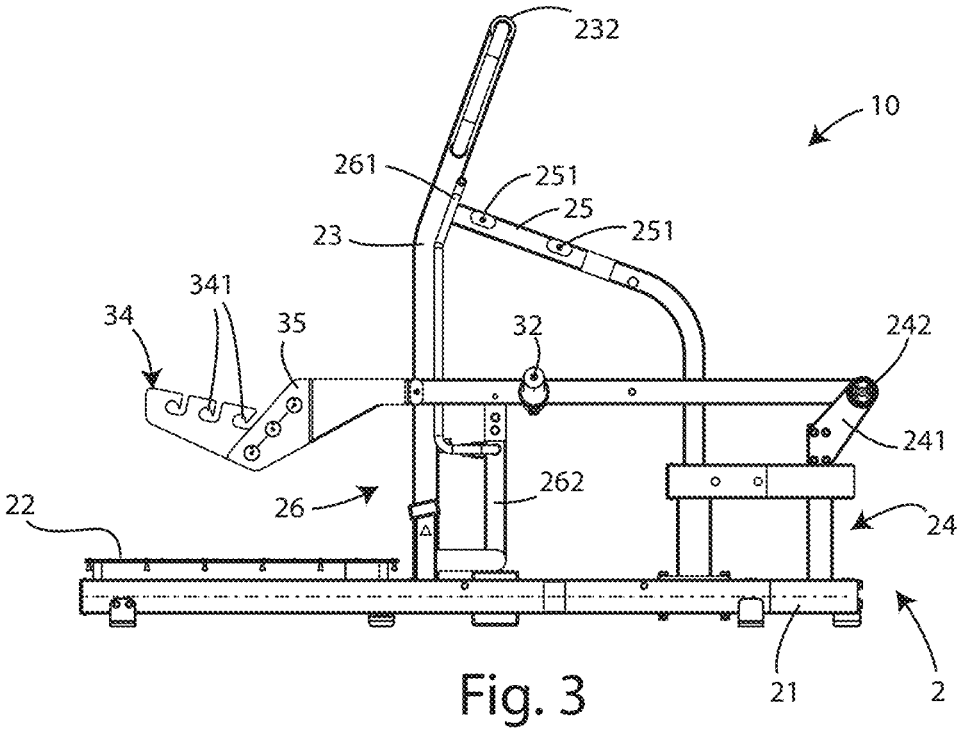
FIG. 3 shows a side view of the gymnastic machine of FIG. 1.
Figure 4:
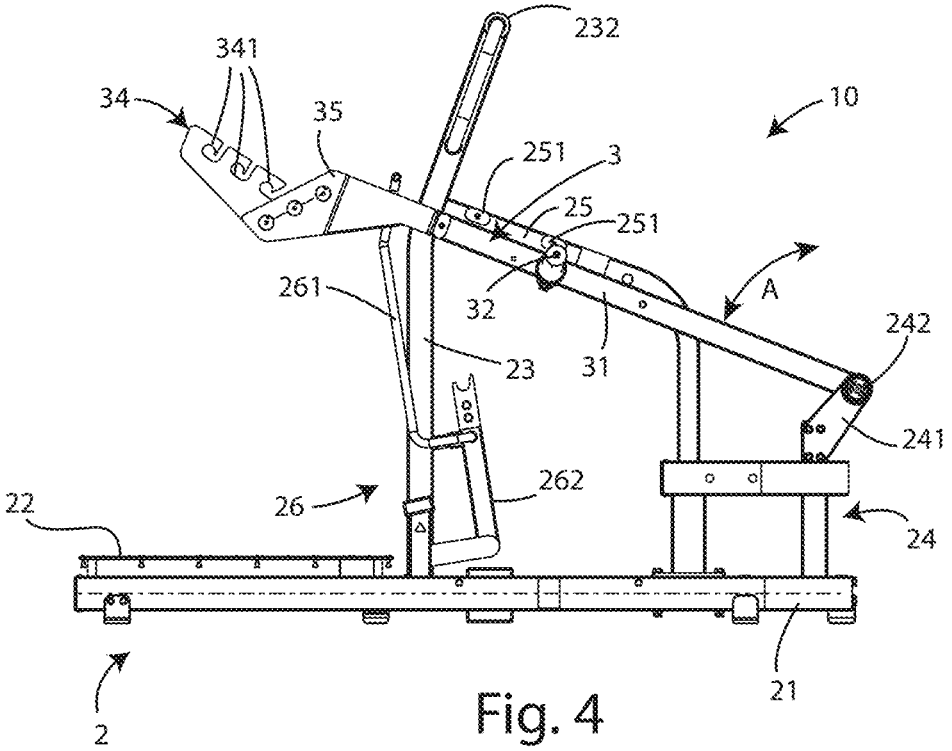
FIG. 4 shows a side view of the gymnastic machine of FIG. 1 in the lifting position.

In the various figures the similar parts will be indicated with the same numerical references.

Referring to FIGS. 1-6, a gymnastic machine 10 according to the present disclosure is observed, in particular of the "belt squat" type.

The gymnastic machine 10 essentially has a frame 2, a movable lever 3, and an elastic element 4 arranged between said support frame 2 and said movable lever 3.

The frame 2 comprises a base 21, having a pair of footplates 22 arranged on a portion of said base 21, and a handlebar 23, having a column 231 fixed at a first end to the base 21, and handles 232, fixed to the second end of said column 23.

The frame 2 also comprises a support element 24, vertically arranged and having a framework 241, which has a rotation pin 242 at the top.

In addition, the frame 2 also comprises a support 25, which in the present embodiment has a curved shape, but which, in other embodiments, can have different shapes. The support 25 is fixed between said base 21 and said column 231. In particular, the support 25 has an upper portion having an end fixed to said column 231, and a lower portion having an end fixed to said base 21. Furthermore, said support 25 comprises, on the sides, for each side, one or more first fixing pins 251, the operation of which will be better defined below. The first fixing pin or pins 251 are preferably arranged in the upper portion of the support 25. Said support 25 can comprise one or more first fixing pins 251 arranged on one side.

FIGS. 1-6 also show a safety unit 26, of a known type, comprising a safety lever 261 and a locking mechanism 262, to block, when operated by means of the safety lever 261, said movable lever 3 when the machine 10 is not in use.

The movable lever 3 is rotatably coupled to the support frame 2 by means of the rotation pin 242.

The movable lever 3 comprises a pair of beams 31 parallel arranged and coupled to each other. Each beam 31 is rotatably coupled to a first end with said framework 241 by means of the rotation pin 242. In this way, said movable lever 3 can rotate around the axis of said rotation pin 242 according to the double arrow A, as shown, in particular, in FIG. 4, and assume a lowered position, when during the exercise the user is at the end of the downward or concentric movement, and a raised position, when during the exercise the user is at the end of the upward or eccentric movement.

Said movable lever 3 also comprises a pair of weight pins 32, each arranged coupled to a respective beam 31, for the arrangement of at least one weight 33 for each weight pin 32, to perform a gymnastic exercise as better defined below.

The movable lever 3 also comprises a coupling portion 34, coupled to both free ends of said beams 31 by means of a coupling element 35, having, in the embodiment under examination, a "Y" shape.

Said coupling portion 34 comprises three hooks 341, arranged in series, whose function will be better defined below.

In the end, on the internal side of each of said beams 31, at least one second fixing pin 36 is provided, which function will be better defined below.

A second fixing pin 36 can be provided on the internal side of at least one of said beams 31. A second fixing pin can be provided on the external side of at least one of said beams 31 or of each of said beams 31.

In particular, at least a second fixing pin 36 is arranged on the internal side of a beam 31 opposite to the side on which the pin 32 extends, on which at least one weight 33 is arranged.

The elastic element 4 connects said movable lever 3 to said frame 2.

In particular, the elastic element 4 is arranged between the upper portion of the frame 2 and the movable lever 3, so as to exert an elastic force in the opposite direction with respect to the force of gravity.

Figure 5:
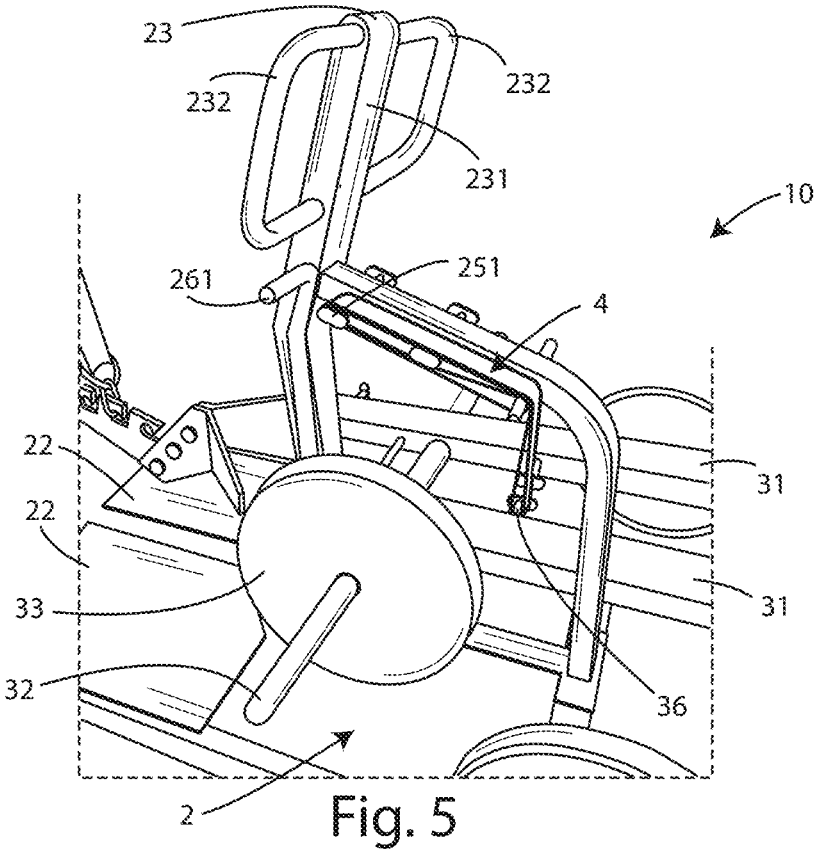
FIG. 5 shows a part of the gymnastic machine according to the present disclosure.

Finally, with particular reference to FIG. 5, an example of the arrangement of the elastic element 4 is observed, which, in the embodiment shown, is a closed elastic band 4, which, as can be seen, it is foldable. The elastic band 4 is arranged between at least a first fixing pin 251 of the support 25 and at least a second fixing pin 36 arranged on the beam 31. In particular, it is observed that the elastic band 4 is arranged and folded between said at least one first fixing pin 251, and one of said at least one second fixing pin 36. It is observed in particular that, based on the length of the closed elastic band 4, it is folded and passed around another first fixing pin 251. Therefore, according to the length and the size of said elastic band 4, it can be arranged in a folded manner to adjust the assistive force that said elastic band 4 exerts near the lowered position, in the eccentric phase of the exercise, i.e., when the movable lever 3 passes from said raised position to said lowered position, and in the concentric phase, i.e., when the movable lever 3 passes from said lowered position to said raised position.

As mentioned, the first fixing pins 251 and the second fixing pins 36 are arranged on both sides of the machine 10. In this way, it is possible to arrange the elastic band 10 on one or the other side of the machine 1, i.e. it is possible to arrange two elastic elements 4, so as to have greater strength, given by both said elastic elements 4.

Furthermore, as can be seen, still referring to FIG. 5, the elastic band 4 is arranged so as to exert an elastic force in the opposite direction with respect to the force of gravity, and therefore of the weights 33.

The operation of the gymnastic machine 1 described above is as follows.

The gymnastic machine 1 according to the disclosure allows performing "squat" or squat exercises to train the leg muscles. For this purpose, the user, as is known, must wear a lifting belt, which can be coupled to one of the hooks 341 of the movable lever 3 of the machine 1. The weights 33 are arranged on the weight pins 32.

In the ascent (concentric phase), the movable lever 3, and in particular, the beams 31, rotate around the rotation pin 242 and the weights 33 obviously oppose resistance due to gravity.

During the descent (eccentric phase) the user bends his legs. Therefore, the movable lever 31 lowers and the elastic band 4, fixed to the pins of the frame 2 and the movable lever 3, extends to partially support the weight/load that the user is moving. Therefore, in the descent phase the technical effect caused by said elastic band 4 is to have a progressively lower load for the user. When going ascent, the user gets up and the elastic band 4 contracts, facilitating the user's ascent, because said elastic band supports part of the load of the weights 33.

Figure 6:
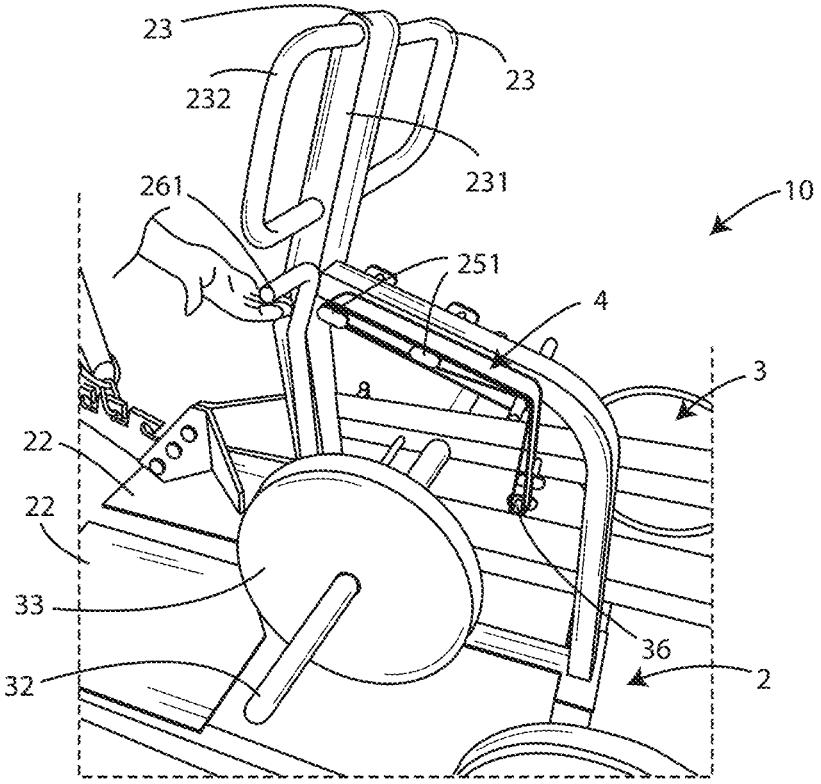
FIG. 6 shows the part of the gymnastic machine according to FIG. 5, in which it is shown how to operate a safety lever.
Figure 7:
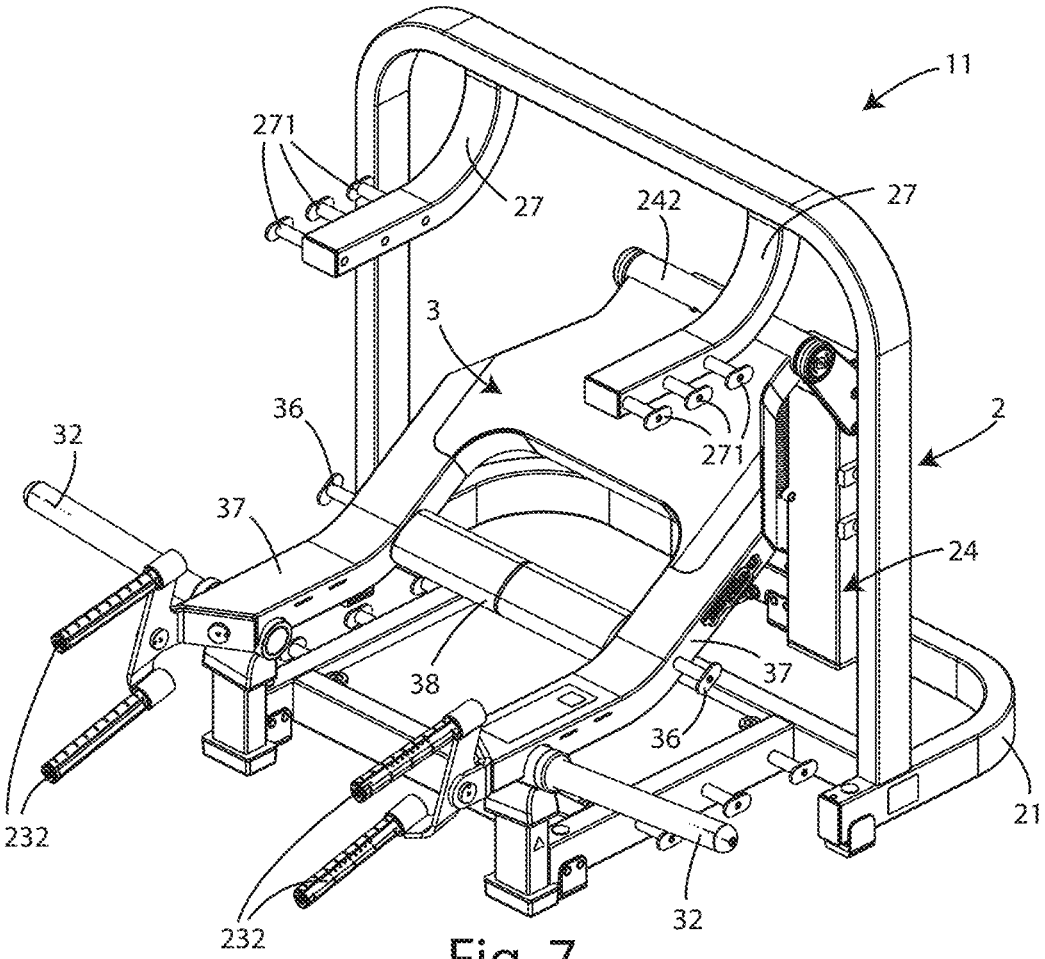
FIG. 7 shows a rear perspective view of a second embodiment of a gymnastic machine according to the present disclosure.
Figure 8:
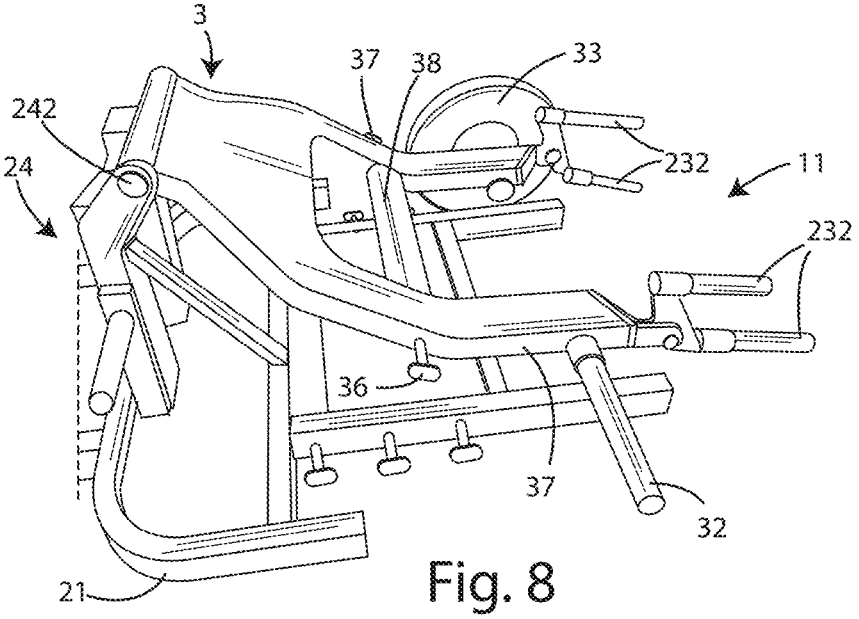
FIG. 8 shows a portion of the exercise machine of FIG. 7.
Figure 9:
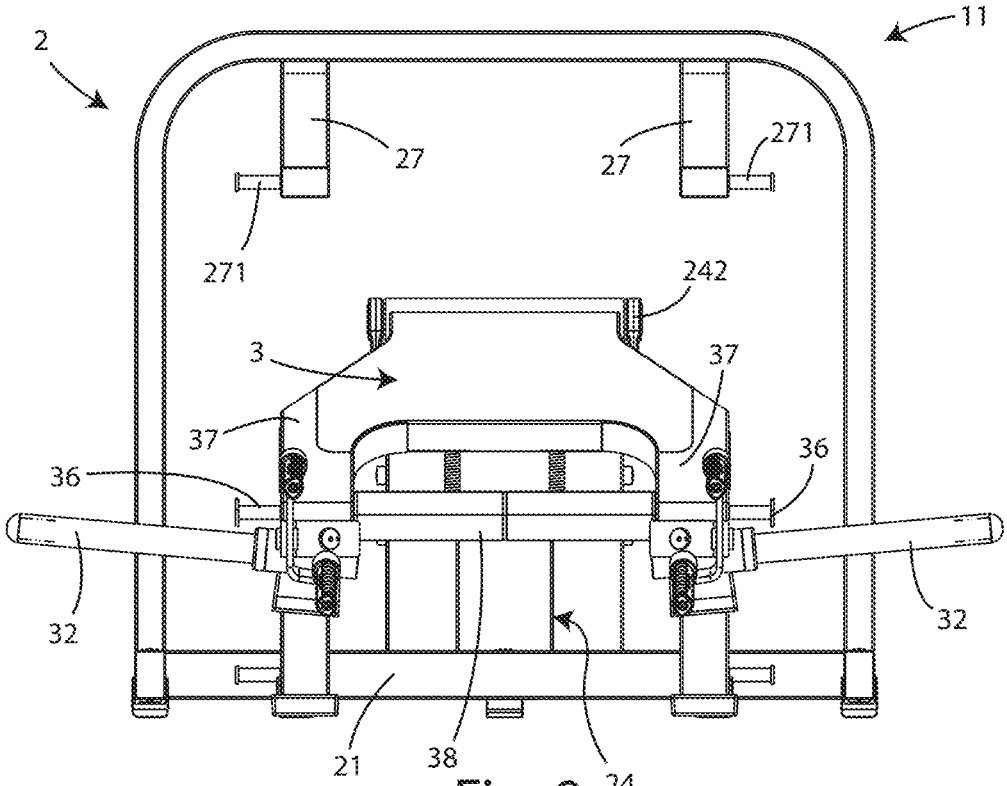
FIG. 9 shows a rear view of the machine of FIG. 7.
Figure 10:
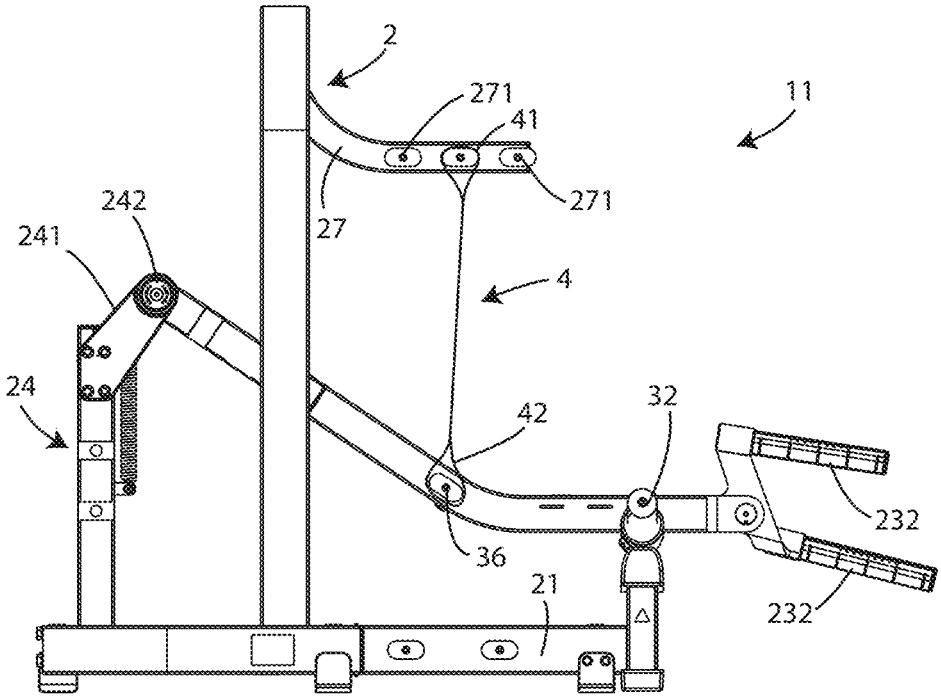
FIG. 10 shows a side view of the machine of FIG. 7.

Naturally, to allow the gymnastic machine 10 to operate, the safety mechanism 262 must be unlocked using the safety lever 261, as shown in particular in FIG. 6.

Referring now to FIGS. 7-11, a second embodiment of the gymnastic machine 11 according to the present disclosure is observed.

In particular, a gymnastic machine 11 is shown, usually called "dead lift", used to train the muscles of the legs and buttocks, in a progressive and physiological way, and also allows performing a lifting movement of a load with just one leg, resting on the ground.

In particular, in the case at issue, a frame 2 is always observed, which comprises a pair of branches 27, on each of which first fixing pins 271 are arranged.

In particular, the branches 27 extend from an upper portion of the frame 2.

The frame 2 comprises a support element 24, arranged vertically and having a framework 241, which has a rotation pin 242 at its top.

The gymnastic machine 11 also in turn comprises a movable lever 3, which has two arms 37 arranged substantially parallel, on each of which at least one of the said second fixing pins 36 are arranged. Between said arms 37 a crosspiece 38 is provided, whose functioning will be better defined below.

The movable lever 3 is rotatably coupled to the support frame 2 by means of the rotation pin 242.

The elastic element 4 connects said movable lever 3 to said frame 2.

In particular, the elastic element 4 is arranged between the upper portion of the frame 2 and the movable lever 3, so as to exert an elastic force in the opposite direction with respect to the force of gravity.

The elastic element 4 in the present embodiment is not closed and has two eyelets 41 and 42 at the ends. Said elastic element 4, as can be seen, is arranged between the frame 2 and the movable lever 3. In particular, the eyelet 41 is arranged on one of the first fixing pins 271, while the other eyelet 42 is inserted in a second fixing pin 36.

Figure 11:
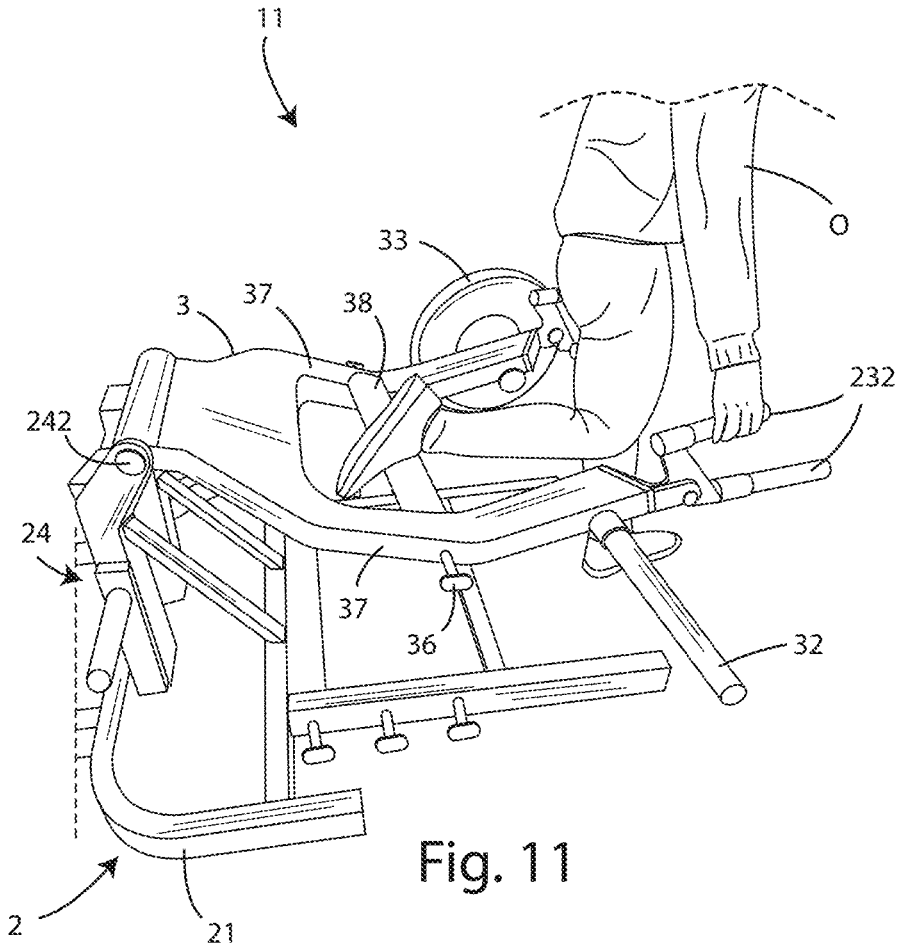
FIG. 11 shows a portion of the gymnastic machine of FIG. 7 in a phase of use.

As seen in FIG. 11, to perform the exercise, a user O must rest one leg on the crosspiece 38, while the other remains resting on the ground. The user O will then be able to grip the handles 232, so as to lift the movable lever 3, to which the weights 33 are coupled on the respective weight pins 32. In this way, the user O will be able to bend and extend the leg not resting on the crosspiece 38 to perform the exercise. As can be seen, near the lowered position, both in the ascent and in the descent phase, the elastic element 4 facilitates the transition between one phase and the other.

An advantage of the present disclosure is that it eases the user in stretching the limbs, increasing the safety.

The present disclosure has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A gymnastic machine comprising:

a frame;

a movable lever pivoted to said frame so as to assume a lowered position and a raised position;

at least one weight coupled to said movable lever; and at least one elastic element connecting said movable lever to said frame, said at least one elastic element configured to exert an elastic and assistive force in an opposite direction with respect to a force due to gravity, and therefore of said at least one weight, when said movable lever is near said lowered position, wherein said movable lever comprises one or more hooks configured to be coupled to a lifting belt worn by a user, wherein said frame comprises a support element having a framework comprising a rotation pin at a top of said framework, wherein said movable lever further comprises a pair of beams arranged in parallel and coupled to each other, wherein each beam of said pair of beams is rotatably coupled at a first end thereof to said rotation pin, so as to assume said lowered position and said raised position, wherein said movable lever further comprises one or more weight pins, each of said one or more weight pins arranged so as to be coupled to a respective beam, for an arrangement of at least one respective weight of said at least one weight, wherein said movable lever comprises a coupling element of said pair of beams, and wherein said one or more hooks are disposed on said coupling element.

2. The gymnastics machine according to claim 1, wherein said frame further comprises at least one first fixing pin wherein said movable lever comprises at least one second fixing pin, and wherein said at least one elastic element is connected between said at least one first fixing pin and said at least one second fixing pin.

3. The gymnastic machine according to claim 1, wherein said frame further comprises:

a base; and a handlebar comprising a column fixed at a first end thereof to said base and handles fixed to a second end of said column.

4. The gymnastic machine according to claim 1, wherein said at least one elastic element is an elastic band.

5. The gymnastic machine according to claim 4, wherein said elastic band is one of a closed elastic band which is foldable in use in said gymnastic machine or an open elastic band comprising two eyelets at ends of said open elastic band.

* * * * *